US006622506B2

(12) United States Patent
Sanders

(10) Patent No.: US 6,622,506 B2
(45) Date of Patent: Sep. 23, 2003

(54) TRANSPORTABLE ICE MAKER

(76) Inventor: William T. Sanders, P.O. Box 1978, Myrtle Beach, SC (US) 29578-1978

( * ) Notice: Subject to any disclaimer, the term of this patent is extended or adjusted under 35 U.S.C. 154(b) by 0 days.

(21) Appl. No.: 10/356,975

(22) Filed: Feb. 3, 2003

(65) Prior Publication Data

US 2003/0150228 A1 Aug. 14, 2003

Related U.S. Application Data

(60) Provisional application No. 60/356,604, filed on Feb. 13, 2002.

(51) Int. Cl.[7] ..... B60H 1/32
(52) U.S. Cl. ..... 62/243; 62/340
(58) Field of Search ..... 62/239, 243, 340

(56) References Cited

U.S. PATENT DOCUMENTS

| | | | | | |
|---|---|---|---|---|---|
| 2,528,795 | A | | 11/1950 | Shontz | 62/105 |
| 3,796,063 | A | * | 3/1974 | Wulke et al. | 62/340 |
| 3,807,193 | A | | 4/1974 | McKenney | 62/322 |
| 4,076,349 | A | | 2/1978 | Gettleman | 312/236 |
| D275,958 | S | | 10/1984 | Burns | D15/80 |
| 4,580,410 | A | | 4/1986 | Toya | 62/347 |
| 4,598,555 | A | * | 7/1986 | Windecker | 62/91 |
| 4,612,779 | A | * | 9/1986 | Hatton | 62/344 |
| 4,992,669 | A | | 2/1991 | Parmley | 290/1 R |
| 5,458,851 | A | | 10/1995 | Schroeder | 422/28 |
| 5,772,075 | A | | 6/1998 | Ash, Jr. | 222/1 |
| 5,787,719 | A | * | 8/1998 | Wilson | 62/236 |
| 5,797,271 | A | * | 8/1998 | Darigo et al. | 62/64 |
| 6,089,420 | A | | 7/2000 | Rodriguez | 222/608 |
| 6,093,312 | A | | 7/2000 | Boulter | 210/86 |
| 6,266,945 | B1 | | 7/2001 | Schroeder | 53/473 |
| 6,289,684 | B1 | | 9/2001 | Guidry, II | 62/229 |

* cited by examiner

*Primary Examiner*—William E. Tapolcai
(74) *Attorney, Agent, or Firm*—McNair Law Firm, P.A.

(57) ABSTRACT

A portable ice making unit including a housing adapted for stacking with cargo containers for land or sea transport. The housing is also capable of being to be attached to the bed of an over land transporter. The ice making unit may be 100% self contained requiring no on site water or electric power. The ice making unit may dispense ice on call or on cash demand.

20 Claims, 4 Drawing Sheets

TRANSPORTABLE ICE MAKER

This application claims priority of Provisional Application Serial No. 60/356,604 filed on Feb. 13, 2002.

BACKGROUND OF THE INVENTION

This invention is directed to an ice manufacturing unit which may be self-contained within a housing. The housing is constructed to be transportable by stacking with cargo containers and transported by rail, by sea or by truck and trailer or simply by being secured with and transported by one of the above transport means.

Transportable ice manufacturing units have long been known with several such units being illustrated in U.S. Pat. Nos. 2,528,795; 5,458,851; 4,992,669; and 6,289,684. These references primarily deal with bulk ice while none of them deal with the combined need of providing a self-contained ice making unit which functions to make and deliver ice to an individual on call.

Accordingly, it is an object of this invention to provide an ice making unit including a housing which is adaptable for transporting by land or sea carriers either singularly or in stacked condition with standard cargo containers.

Another object of the invention is an ice making unit which is completely housed with a portable housing unit.

Another object of the invention is a portable ice making unit which is completely self-contained.

Another object of the invention is an ice making unit which is partially contained.

Another object of the invention is a transportable ice making unit with a dispenser adapted for filling coolers and sacks.

Another object of the invention is an ice making unit which may operate while being transported or while stationary.

Another object of the invention is to eliminate the necessity to provide bulk ice shipments to isolated areas for later use.

SUMMARY OF THE INVENTION

The instant inventing is directed to a portable ice making unit which includes a portable housing carrying the ice making and dispensing equipment. The housing is preferably formed metal, is constructed to be 20 ft. or 40 ft. in length and about 8 ft. in height and width. The housing is divided into two compartments, an open compartment and an enclosed compartment. The housing is also provided with locking members at each corner which are operative to engage with the bed of a transport member or with a cargo container allowing the ice making unit to be transported in single level fashion or in stacked fashion. The ice making unit is constructed to be transported by land or sea transport.

The open compartment is formed with a floor and a frame to which is secured meshed wire such as chain link fence wiring. A door is located at a convenient point along an end or side.

Panel members may be provided which are of a size to cover the open end, top and side sections of the open compartment. These panel members may be attached to enclose the open compartment during transport. Once the ice making unit is in position, the panels are removed prior to ice being made.

The open compartment may house a fuel tank, a generator and a remote condenser. It also may house the exhaust of an air conditioning unit which controls the temperature within the control unit.

The enclosed compartment carries an ice machine, an ice dispenser and a pre-charged line set which interconnects with the condenser and the ice machine. A control panel and an air conditioner are also arranged within the enclosed compartment. Also, a water filter, a water pump and a water tank are provided.

It is understood that if the use site includes electrical power, the generator and fuel tank may be omitted. Also, if the site includes a water supply, the water tank and water pump may be omitted.

The housing includes an opening in the side panel through which the ice dispenser passes ice by way of an ice chute. The chute includes a chute extension which engages outside of the housing with the chute. The extension receives ice from the chute and directs it as desired. The chute extension is removable and is detached during transport of the ice making unit. A cover may be provided over the opening.

A dispensing panel may be connected with the housing side to receive ice from the ice dispenser. The dispensing panel includes a display panel and a dispensing section. The dispensing section includes a delivery chute and a tray arranged beneath the display panel. The tray is located at least 2 ft. beneath the delivery chute and will accommodate an ice chest. A bag dispenser is also provided.

An activating device including a money changer is carried on the face of the dispensing panel.

The ice making unit finds use at building sites, disaster areas, concert or convention areas and undeveloped areas. It is designed for easy transport and for long term use in a fixed area.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein:

Turning now to the drawings, FIGS. 1 and 3 show portable ice making unit 10 mounted with trailer 12 and parked in a desired location ready for use. Ice making unit 10 includes housing 14 which comprises open compartment 16 and enclosed compartment 18.

Figure 1:
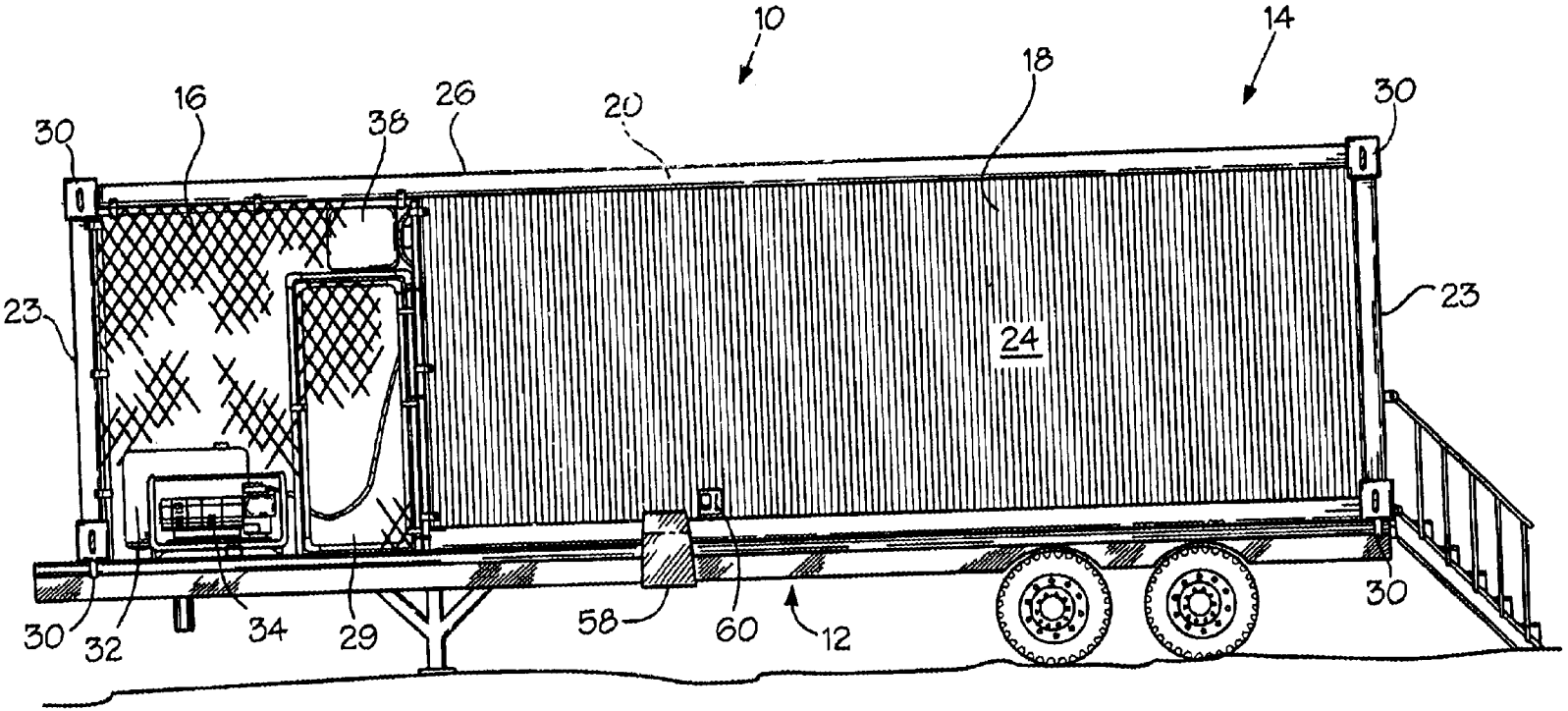
FIG. 1 is a side view of the portable ice making unit united with a trailer.

Housing 14 is constructed to be 20' or 40' long and about 8' in height and width. Preferably housing 18 is constructed of steel and with structural strength to be capable of supporting a multiple of its weight up to at least 100,000 lbs.

Horizontal and vertical members form truss 20 to which a plurality of panels are attached for forming floor 22, side walls 24 end walls 23, 23' and top 26. End wall 23 comprises a pair of panels 23A, 23B which are hinged to opposing sides 24. Panels 23A, B may be swung open to allow placement of the components within enclosed compartment 18. Door 27 is formed in panel 23B of end wall 23 of normal access into the enclosed compartment.

Open compartment 16 is encased or caged along its sides, end and top by a wire mesh 28, such as chain link fence wire, and includes a door 29 for access. Door 29 is of a width which allows passage for all components within the open compartment.

Figure 1A:
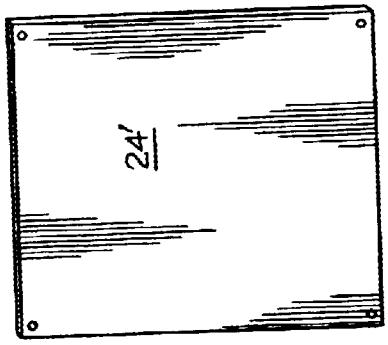
FIG. 1A is a side view of a detachable panel for attachment with the open compartment during transport.
Figure 2:
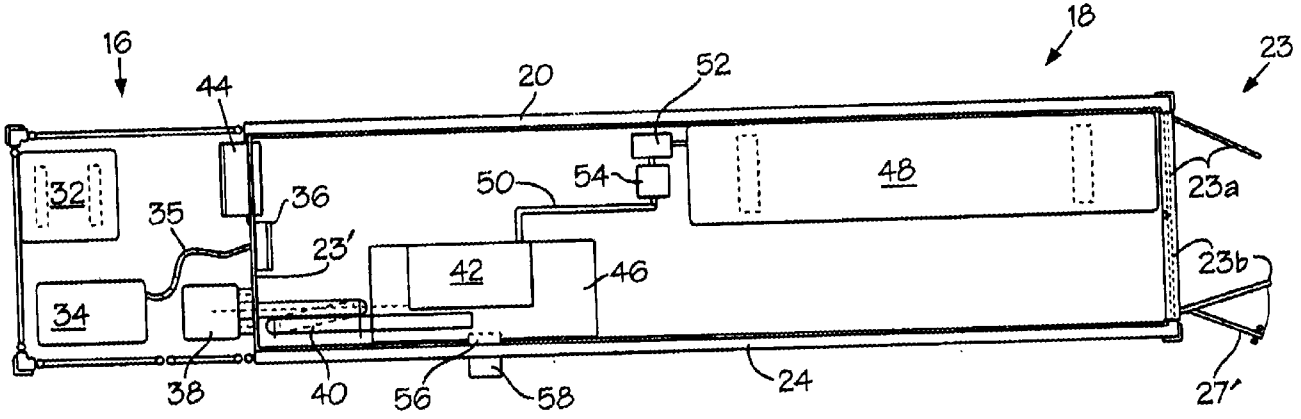
FIG. 2 is a cutaway top view of the ice making unit.
Figure 3:
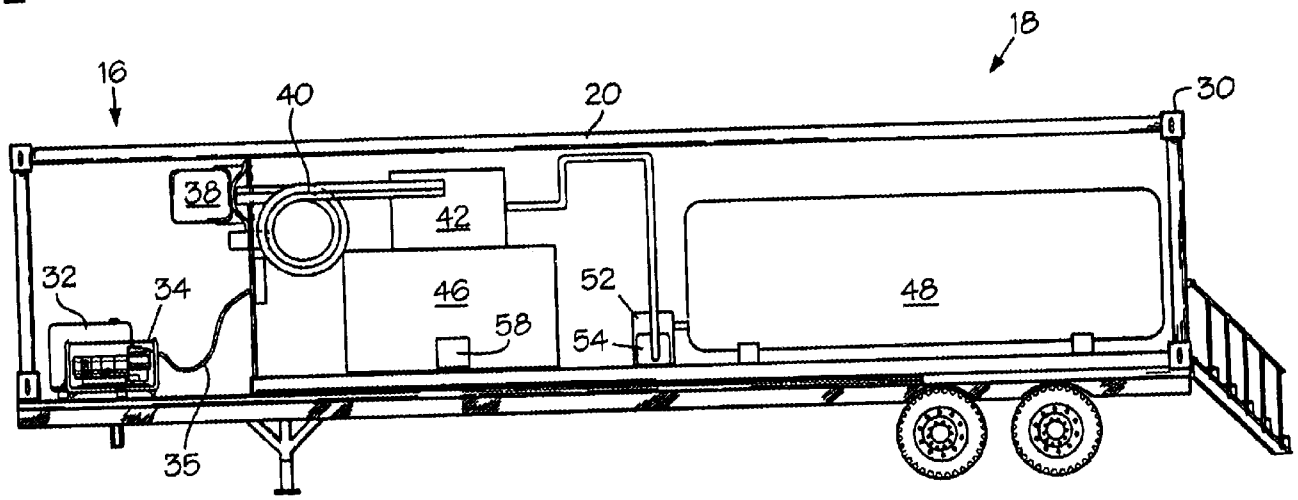
FIG. 3 is a side view of the ice making unit.

Panel members 24', shown in FIG. 1A, which are of a size substantially equal the open end, top and sides of open compartment 16 may be removably attached with truss 20 forming housing 14 to be completely enclosed during shipping, and particularly when shipping by sea. Panels 24' are removed once ice making unit 10 is positioned to make ice.

Each corner of truss 20 includes a latching unit 30, each of which is operative to engage with the bed of a land carrier such as trailer 12 or with a rail car bed. Latching units 30, which are standard with cargo containers, are also operative to engage housing 14 with cargo containers allowing housing 14 to be stacked with the cargo containers for sea and rail transport.

Mounted on floor 22 within open compartment 16 is a fuel tank 32, generally for diesel fuel, and a diesel driven generator 34.

Generator 34 is connected with control panel 36 by lead 35. Control panel 36 is mounted with end wall 23' within enclosed compartment 18.

Remote condenser 38 is also located in open compartment 16 and connects with pre-charged line 40 which passes through end wall 23' to connect with ice machine 42 within enclosed compartment 18.

The arrangement thus far described can function using electricity supplied by a utility. The electrical source would simply be connected with lead 35 in a usual manner. In this situation there would be no need for the entire open compartment 16 to be open. It may be desirable to provide solid panels around the lower half leaving only the upper half and top of compartment 16 open.

It is preferred that generator 30 have a capacity of between 8.5 kw to 80 kw, that fuel tank 32 have a capacity of between 5–150 gallons, and that remote condenser have a capacity of between 400–3800 lbs/day.

Enclosed compartment 18 includes electrical control panel 36 and pre-charged line 40 carried by end wall 23'. Also carried by end wall 23' is an air conditioning unit 44 with its exhaust being directed into open compartment 16 and with a capacity of between 5,000 and 15,000 btu for maintaining the temperature within the enclosed compartment at a desired level. Door 27' provides easy access.

Pre-charged line 40 connects with ice making machine 42 which is connected with ice dispenser 46. Water may be supplied by way of water tank 48, line 50, pump 52 and water filter 54.

In the event that water is available on the selected site, tank 48 and pump 52 may be eliminated. The on-site water could simply be connected with line 50, preferably behind filter 54.

An opening 56 is provided in side wall 24 adjacent to ice dispenser 46. Chute 58 is designed to pass through opening 56 and to be removably engaged in any suitable manner with the ice dispenser as shown. It is preferred that during transport chute 58 be disconnected from the ice dispenser and located within the enclosed compartment. Also, it is preferred that opening 56 be covered during transport.

An actuator 60, usually a button, is mounted in side wall 24 adjacent opening 56. Actuator connects with control panel 36 through circuitry. Control panel 36 through usual circuitry controls ice making machine 42, dispenser 46, panel 52 and air conditioner 44.

In use, transportable ice making unit 10 is moved to a desired area and disconnected from the transporting unit. In some instances, the housing of the ice making unit is set up on an on-site pad, in other instances the housing is left on the trailer as indicated in FIG. 1.

In position, ice making unit 10 functions to supply ice on demand through chute 58. Normally, a container is positioned below chute 58, actuator 60 is pressed which initiates through control 36 delivery of ice from ice dispenser 46 through the chute and into the container.

Figure 4:
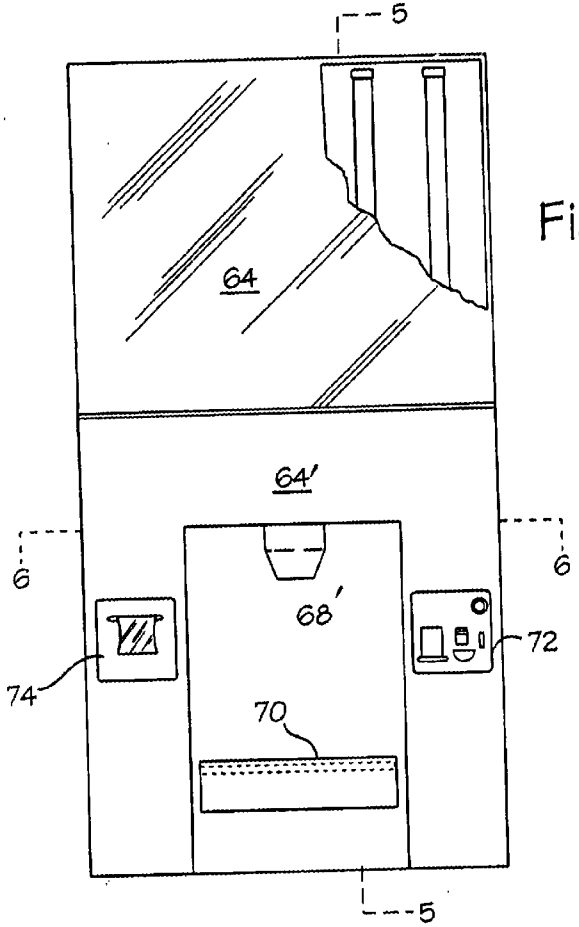
FIG. 4 is a front view of a dispensing panel for use with the ice dispensing unit.
Figure 6:
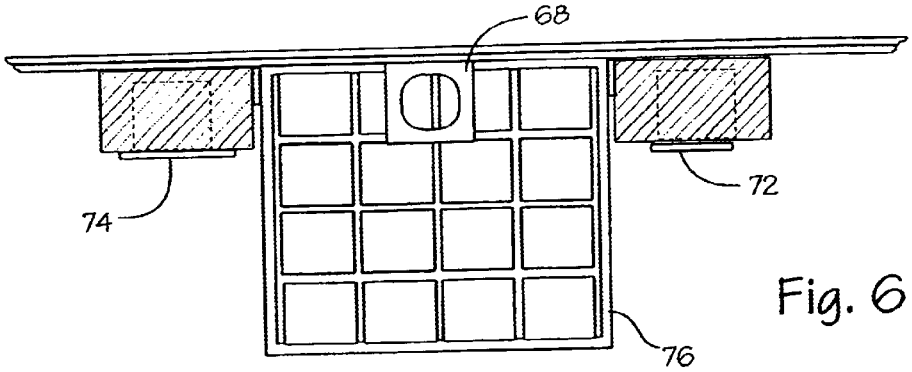
FIG. 6 is a cutaway top view along line 6—6 of FIG. 4.
Figure 7:
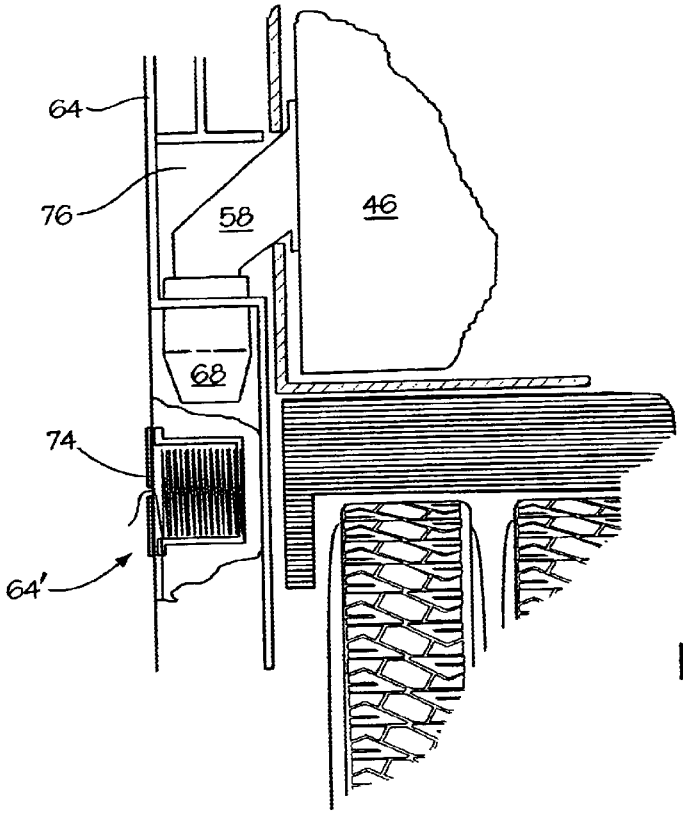
FIG. 7 is an exploded cutaway view similar to FIG. 5.

It is noted that all equipment described, remote condenser 38 ice machine 42, ice dispenser 46 are commercially available and function in their normal manner. It is preferred that the remote condenser has a capacity of between 400–3m800 lbs/day, the ice machine a capacity of 4190–10,000 lbs per day and the ice dispenser a capacity of between 450–2,800 lbs. The water tank should have a capacity of between 320–1800 gallons is provided on one side of recess 66 while a bag dispenser 24 is provided on the opposite side of the recess. It is noted the bag dispenser may dispense bags from a roll as shown in FIG. 4 or bags from a package as shown in FIG. 6.

An alternative arrangement is shown in FIGS. 4–7. A dispensing panel 62 which includes a lighted display panel 64 and a delivery section 64'. Delivery section includes a recessed opening 66 which carries a delivery chute 68 with a support tray 70 arranged at least 2' beneath the chute. Tray 70 is designed to receive and support an ice chest in position to be filled with ice.

Figure 5:
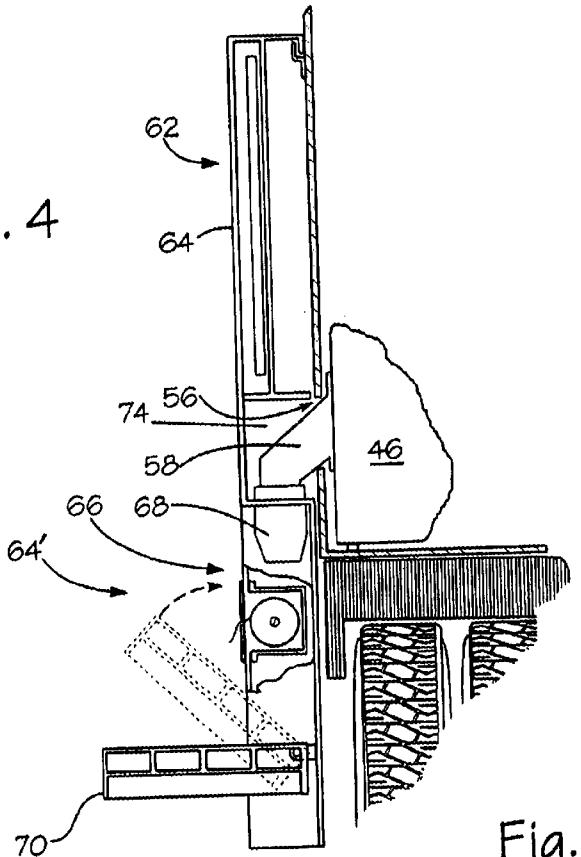
FIG. 5 is a cutaway side view along line 4—4 of FIG. 4.

Dispensing panel 62 is designed to be engaged with side wall 24 in position for chamber 76 to receive chute 58. Delivery chute 68 is designed to receive the delivery end of chute 68 as shown in FIG. 5.

Actuator 72 is connected in any convenient manner with control panel 36 and operates to actuate ice dispenser 46 to deliver ice through chute 68.

An actuator 72 which may include a money changer, a coin receptacle and an actuating or start button is provided for actuating ice dispenser 46 to deliver ice through chutes 58 and 68 when proper monies have been deposited.

Dispensing panel 62 along with chute 58 are designed to be disconnected from side wall 24 and secured within enclosed housing.

While a preferred embodiment of the invention has been described using specific terms, such description is for illustrative purposes only, and it is to be understood that changes and variations may be made without departing from the spirit or scope of the following claims.

What is claimed is:

1. An ice making unit comprising:

a housing adapted to be removably secured, with a mobile land container carrier, and a sea container carrier for transport, said housing having an enclosed area and an open area;

said open area containing a remote condenser, a generator and a fuel supply for said generator;

said enclosed area, in fixed position relative to said open area, containing an ice machine, an ice dispensing unit and a water tank for supplying water to said ice machine; wherein, said ice making unit may be transported to an area having no electric and water supply and activated to produce ice at said area.

2. The ice making unit of claim 1 wherein said ice dispensing unit is connected with an opening in a side of said enclosed area, said ice dispensing unit being capable of delivering ice through said opening.

3. The ice making unit of claim 2 wherein said ice dispensing unit includes a panel having an ice chute, a bag dispenser, support tray and an activating device.

4. The ice making unit of claim 3 wherein said support tray is located approximately two feet beneath said dispenser for accommodating an ice cooler and an ice bag.

5. The ice making unit of claim 3 wherein said bag dispenser includes a dispenser for supporting one of a roll of bags and a package of bags.

6. The ice making unit of claim 1 including a coin operated control for controlling actuation of said ice dispenser.

7. The ice making unit of claim 1 wherein said housing is 20' or 40' in length and about 8' in width and height.

8. A portable ice making unit capable for transport by ground carriers and sea carriers comprising:

a metal housing of generally rectangular shape, said housing having longitudinal and vertical support members interengaged to form a truss capable of supporting a multiple of its weight, panels engaging with a portion of said truss forming a floor along the length of said housing and an enclosed compartment along a portion of said length, wire grating engaging with the remainder of said truss forming an open compartment at one end thereof;

a locking unit arranged at each corner of said housing, said locking units being capable of securing said housing with cargo containers with said ground carriers and with said sea carriers in single and stacked profile for transport said enclosed compartment containing an ice machine and an ice dispenser, said ice dispenser engaging with an opening in an adjacent of said panels; said open compartment containing a remote condenser connected with said ice machine; whereby, said portable ice making unit may be transported to a desired location and activated to produce ice.

9. The portable ice making unit of claim 8 wherein said enclosed compartment includes a water supply, a water pump and an electric control panel allowing said ice making unit to provide its own water supply.

10. The portable ice making unit of claim 8 wherein said open compartment includes a generator and a fuel supply, wherein said ice making unit may provide electric power.

11. The portable ice making unit of claim 8 wherein said ice making unit includes a water filtering unit.

12. The portable ice making unit of claim 8 wherein said ice dispenser includes a chute, said chute passing through said opening for guiding said ice when dispensed from said ice dispenser.

13. The portable ice making unit of claim 8 including an actuator, said actuator comprising a money changing and receiving unit and a start button for activating said ice dispenser to dispense ice.

14. The portable ice making unit of claim 8 wherein said housing is constructed to be 20 or 40 feet in length.

15. The portable ice making unit of claim 8 wherein said ice making machine produces ice cubes.

16. The portable ice making unit of claim 8 including removable panels secured with said grating enclosing said open compartment during transport.

17. The portable ice making unit of claim 8 including an air conditioning unit for controlling the air temperature within said enclosed compartment.

18. The portable ice making unit of claim 8 including a dispensing panel overlaying said opening and connected with said ice dispenser, said dispensing panel including a display front, an ice delivery chute, a bag dispenser and a shelf arranged below said dispenser.

19. The portable ice making unit of claim 8 including an activating switch arrange on said side panel adjacent said opening, said activating switch being operative to control said ice making unit to deliver ice through said opening.

20. The portable ice making unit of claim 8 wherein said ice making unit may be activated to make ice in position on said mobile carrier and in position off said mobile carrier.

* * * * *